US005555726A

United States Patent [19]

Huebner

[11] Patent Number: 5,555,726

[45] Date of Patent: Sep. 17, 1996

[54] ATTENUATION OF FLUID BORNE NOISE FROM HYDRAULIC PISTON PUMPS

[75] Inventor: Robert J. Huebner, Peoria, Ill.

[73] Assignee: Caterpillar Inc., Peoria, Ill.

[21] Appl. No.: 414,869

[22] Filed: Mar. 31, 1995

[51] Int. Cl.[6] ..... F16D 31/02; F04B 49/00

[52] U.S. Cl. ..... 60/469; 417/282; 417/440

[58] Field of Search ..... 60/468, 469, 494; 92/12.2, 57, 71; 417/312, 282, 440, 269

[56] References Cited

U.S. PATENT DOCUMENTS

| | | | |
|---|---|---|---|
| 3,606,243 | 9/1971 | Ichiryu et al. | 251/118 |
| 3,660,979 | 5/1972 | Kamakura et al. | 60/52 |
| 3,898,806 | 8/1975 | Press | 60/469 X |
| 3,956,969 | 5/1976 | Hein | 91/6.5 |
| 4,836,754 | 6/1989 | Ikeda et al. | 417/269 |
| 5,086,689 | 2/1992 | Masuda | 417/269 X |
| 5,112,198 | 5/1992 | Skinner | 417/269 |
| 5,186,614 | 2/1993 | Abousabha | 417/312 |
| 5,247,869 | 9/1993 | Palmberg et al. | 91/487 |

OTHER PUBLICATIONS

"The dB(A)s of Hydraulic System Noise", Russ Henke P.E., Diesel Progress Engines & Drives, pp. 42–46, Jul. 1994.

Paper No. 911762, "Methods of Reducing Flow Ripple from Fluid Power Pumps—A Theoretical Approach", Pettersson et al., Linkoping Univ. (No Date).

Paper No. 911763, "Methods of Reducing Flow Ripple from Fluid Power Piston Pumps—an Experimental Approach", Weddfelt et al, Linkoping Univ. (No Date).

*Primary Examiner*—Hoang Nguyen

*Attorney, Agent, or Firm*—J. W. Burrows

[57] ABSTRACT

In many hydraulic systems, fluid borne noise is generated during operation due to the effects of the hydraulic piston pump. This fluid borne noise is transmitted to various structures of the hydraulic system which emit vibrations that create the largest portion of the system air borne noise. In the subject invention, an apparatus is provided for the attenuation of fluid borne noise. The apparatus includes a sensor arrangement operative to sense operating system parameters and deliver signals representative thereof to a microprocessor, a porting arrangement within the hydraulic piston pump that includes a secondary port, a fluid chamber, and first and second passageways interconnecting the secondary port, the fluid chamber, and a discharge passage. The microprocessor receives the signals from the sensor arrangement and directs electrical command signals to an electrically controlled valve mechanism disposed in the first and second passageways. The microprocessor and the valve mechanism operate to control fluid flow between the discharge passage, the fluid chamber, and the secondary port. By pressurizing fluid in the fluid chamber which in turn pre-pressurizes the piston port through the secondary port prior to the piston port entering the discharge passage, the flow required to pressurize the piston port prior to the piston port entering the discharge passage is spread over a larger range of piston port rotation.

12 Claims, 5 Drawing Sheets

ATTENUATION OF FLUID BORNE NOISE FROM HYDRAULIC PISTON PUMPS

DESCRIPTION

1. Technical Field

This invention relates generally to the attenuation of noise in a machine having hydraulic components and more particularly to the apparatus for the attenuation of fluid borne noise excited by the hydraulic piston pump.

2. Background Art

It is well known that some of the noise generated in machines is attributed to hydraulic noise transmitted in various forms such as air borne, fluid borne, and/or structure borne. Attempts have been made in the past to control hydraulic noise by enclosing the hydraulic system in an acoustical enclosure. However, this is not feasible in many systems because some of the hydraulic components and the structures that they are mounted on are separated by significant distances. It is well known, that the hydraulic pump is one of the primary sources of hydraulic noise in a hydraulic system. The hydraulic pump excites fluid borne noise which is subsequently transmitted to the valves, lines, cylinders and the structures that the valves, cylinders and lines are associated with. These structures then emit vibrations that create the largest portion of the overall air borne noise attributed to the hydraulic system. Therefore, reduction of fluid borne noise is a key to the reduction of the noise generated in the hydraulic system.

Hydraulic piston pumps or motors, due to their geometry, port timing, and speed, inherently produce a flow ripple that excites pressure waves known as fluid borne noise. The total flow output of the hydraulic piston pump is geometrically proportional to the sum of the velocities of the individual pistons between the bottom dead center (BDC) and the top dead center (TDC) positions. The uneven delivery of fluid flow resulting from the sum of the velocities not being constant is one of the inherent characteristics of a pump that contributes to the flow ripple. The second source of flow ripples is due to pressure changes that occur in the respective piston cavities near BDC when the pump is operating at some outlet pressure other than a low pressure equal to inlet pressure. When the piston port reaches BDC, the piston cavity is normally at inlet pressure. Until the pressure in the piston cavity reaches discharge pressure, the velocity of that piston does not contribute to the pump's total output flow. Also, if the pressure in the piston cavity is not the same as the discharge pressure when the piston cavity enters the discharge port, there is an in-rush or out-rush of fluid flow between the piston cavity and the discharge cavity. This causes a disturbance in the pump's output flow. The amount and rate of flow change near BDC varies depending on the geometry of the piston cavities, the volumetric displacement of the pump, the port configuration, the pump speed, and the output pressure. Thus, the flow ripple depends not only on the geometric sum of the piston's velocities, but also on the pressure at which the pump is operating, the pump displacement, the pump porting, and the speed of the pump. By reducing the flow ripple, the fluid borne noise excited by the pump is substantially reduced along with the structure borne noise and the air borne noise that are associated with the hydraulic components and structures downstream thereof.

Various attempts have been made to reduce fluid borne noise in hydraulic systems by installing various mufflers and/or dampers. Likewise, port timing is sometimes changed within the pump in an attempt to modify the pressure ripple.

Even though some of these attempts have proven to be partially successful, they are normally only successful when operating within narrow pressure, speed and displacement ranges of the pump. There have been some attempts at providing apparatus totally separate from the hydraulic piston pump that operates to add and subtract flow to the system in response to variations of the flow in the system attributed to the flow ripple therein. Likewise there have been attempts to provide fixed porting within the pump which connects a separate volume of discharge fluid to the cylinder port relative to the rotation of the barrel containing the pistons. This type of arrangement adds complexity to machining of the internal porting. In order to eliminate the need for an external mechanism or rely solely on fixed porting within the pump to add and/or subtract flow to the system, it is desirable to have means to variably control the flow pattern within the hydraulic piston pump to effectively control the fluid borne noise therein when operating at different speeds, pressures, and/or displacements.

The present invention is directed to overcoming one or more of the problems as set forth above.

DISCLOSURE OF THE INVENTION

In one aspect of the present invention, an apparatus is provided for the attenuation of fluid borne noise in a hydraulic system caused by flow ripples produced by a hydraulic piston pump that is drivingly connected by a pump input shaft to a power source. The porting face of the hydraulic piston pump body has an inlet passage, a discharge passage, and a secondary port disposed between the inlet and discharge passages near a BDC position. The face of the rotating cylinder barrel contains a plurality of piston ports that are rotatably disposed relative to the inlet passage, the discharge passage and the secondary port. A fluid chamber of a predetermined volumetric size is connected by a first passageway to the secondary port and a second passageway to the discharge passage. An electrically controlled valve mechanism is disposed in the first and second passageways and is operative to control fluid flow between the fluid chamber, the secondary port, and the discharge passage. A sensor arrangement is included and operative to supply electrical signals representative of the pump's operating parameters to a microprocessor. The microprocessor receives the electrical signals from the sensor arrangement, processes the electrical signals with respect to programmed parameters and transmits electrical command signals to the electrically controlled valve mechanism to selectively control the flow of fluid between the fluid chamber, the secondary port and the discharge passage in response to the operating parameters of the pump.

The intent of the present invention is to substantially reduce the flow ripple produced by the pump, thus maintaining a generally uniform total flow to the rest of the system. The reduction of the flow ripple is accomplished by providing an internal porting arrangement within the pump and an apparatus therein to control the flow through the porting arrangement. This mechanism selectively absorbs and releases fluid relative to the pumps discharge passage in order to spread, over a longer time period, the discharge flow reduction necessary to bring a piston cylinder up to discharge pressure during the BDC pressure transition. Lengthening the time period thereby reduces the amplitude of the temporary flow reduction during the transition. The subject arrangement effectively ensures that the fluid borne noise excited by the hydraulic piston pump is substantially reduced over the entire operating range of the pump's speed, pressure, and displacement.

BEST MODE FOR CARRYING OUT THE INVENTION

Figure 1:
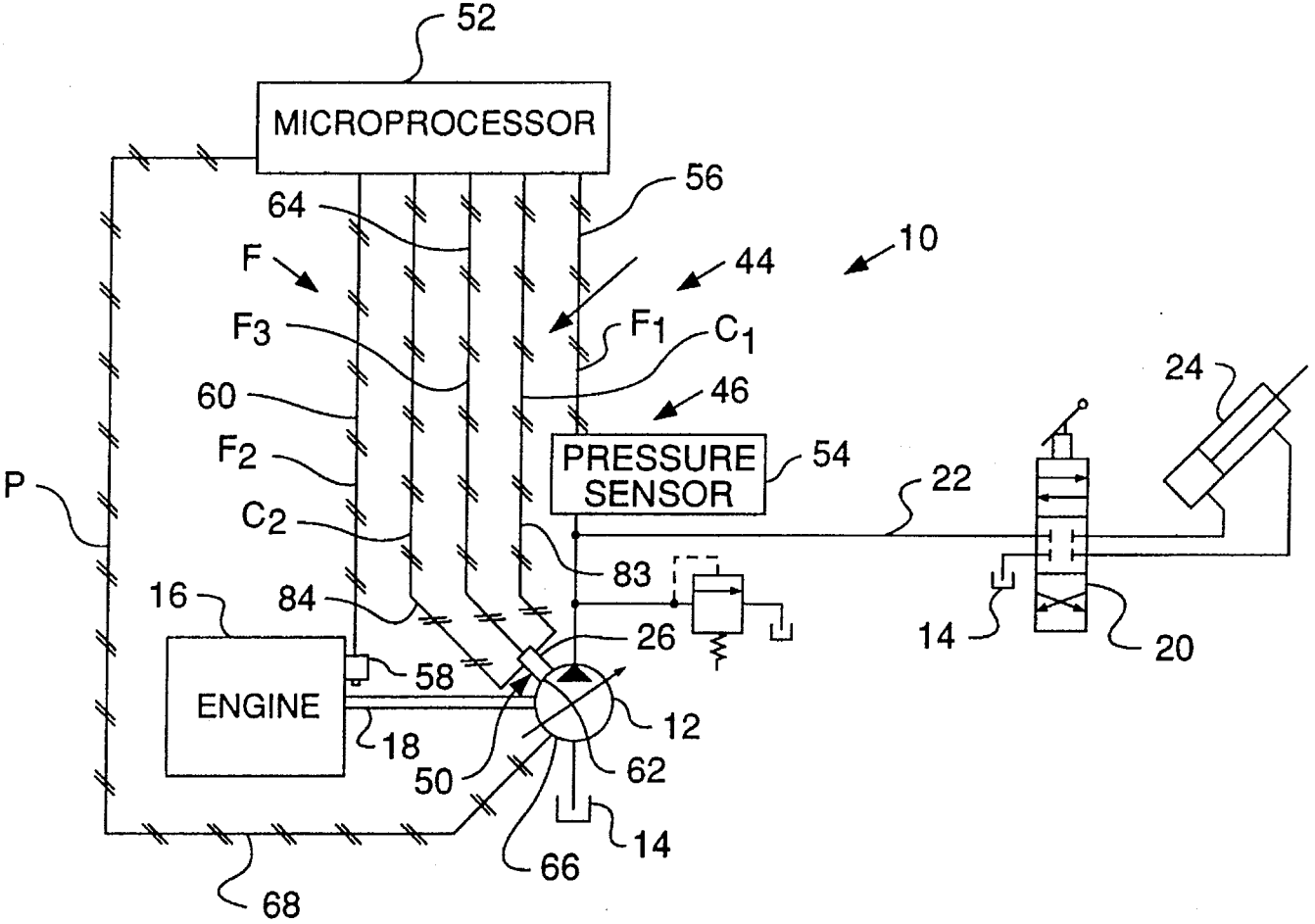
FIG. 1 is a schematic representation of a hydraulic system incorporating an embodiment of the present invention.

Referring to FIG. 1 of the drawings, a hydraulic system 10 is illustrated and includes a hydraulic piston pump 12 adapted to receive fluid from a reservoir 14 and drivingly connected to a power source, such as an engine 16, by a pump input shaft 18. The hydraulic system 10 includes a directional control valve 20 connected to the hydraulic piston pump 12 by a conduit 22 and fluidly connected to a cylinder 24 in a well known manner. It is recognized that the cylinder 24 could be any type of actuator, such as, for example, a fluid motor.

The hydraulic piston pump 12 could be of an axial or radial design without departing from the essence of the invention. Likewise, the hydraulic piston pump 12 could be a hydraulic piston motor. In the subject drawings, an axial piston pump is being illustrated and described. As is well known, the hydraulic piston pump 12 inherently produces flow ripples during its normal operation. These flow ripples are normally produced as a direct result of the pump's geometry, port timing, outlet pressure, and rotational speed. The hydraulic piston pump 12 is a variable displacement pump having a displacement controller 26 attached thereto for control of fluid flow therefrom in a well known manner.

Figure 2:
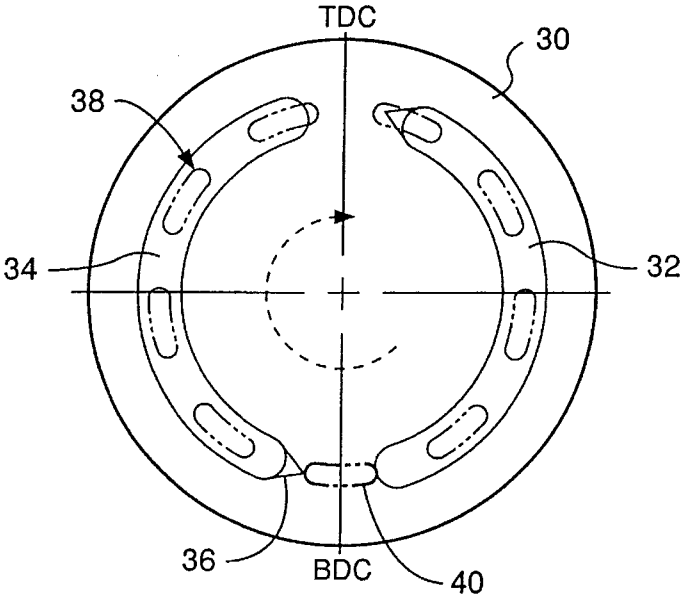
FIG. 2 is a diagrammatic representation of a typical hydraulic piston pump with one of the piston ports associated therewith illustrated at its BDC position.

FIG. 2 represents a typical valve face 30 that is representative of a hydraulic piston pump having nine pistons. As illustrated, the valve face 30 has an elongated inlet passage 32 that is in communication with the reservoir 14 in a well known manner. The valve face 30 also includes an elongated discharge passage 34 that is in communication with the conduit 22 as illustrated in FIG. 1. The discharge passage 34 has a well known bleed slot 36 disposed on one end thereof. A plurality of piston ports 38 are illustrated by phantom lines. As is well known in the art, the plurality of piston ports 38 are equally spaced from one another and are defined in a cylinder barrel (not shown) and rotate relative to the valve face 30. Likewise, the well known hydraulic piston pump 12 has a bottom dead center (BDC) position, and a top dead center (TDC) position. The BDC position is the position at which each of the respective pistons has completed its motion out of its respective piston cylinder and is in position to move back into the piston cylinder upon further rotation of the cylinder barrel. As illustrated, one piston port 40 is illustrated at the BDC position. In this position, the one piston port 40 is out of contact with the inlet passage 32 and likewise out of contact with the bleed slot 36 of the discharge passage 34. At this position, the one piston port 40 is full of hydraulic fluid and as illustrated is in position to initiate discharge of the hydraulic fluid therefrom as the barrel rotates in a clockwise direction.

Figure 3:
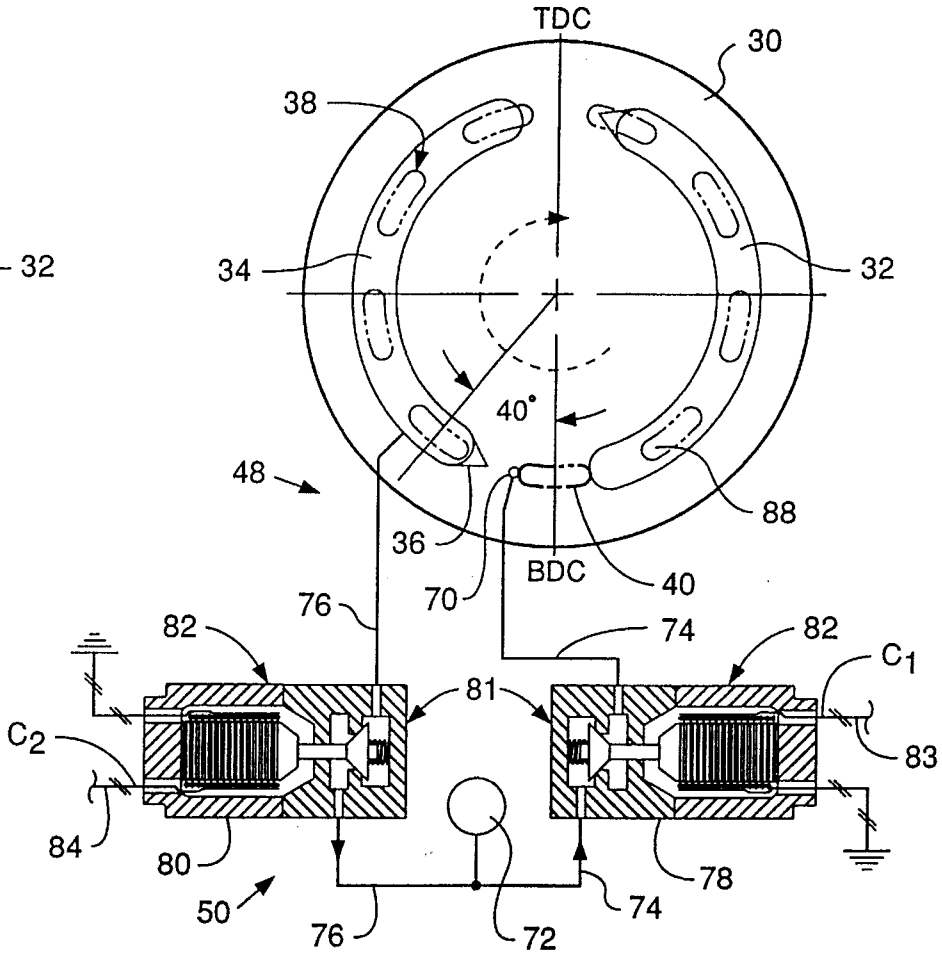
FIG. 3 is a partial diagrammatic representation and a partial schematic representation of a valve face of a hydraulic piston pump incorporating an embodiment of the present invention with one of the piston ports associated therewith illustrated at its BDC position.

Referring to FIG. 3, the arrangement therein is quite similar to that illustrated in FIG. 2. Like elements have like element numbers. Referring to Fig. 1 in conjunction with FIG. 3, an apparatus 44 is provided in the hydraulic system 10 for the attenuation of fluid borne noise. The apparatus 44 includes a sensor arrangement 46 that is operative to sense pump operating parameters and generate electrical signals "F" representative of the pump's operating parameters. A porting arrangement 48 is included in the apparatus 44 and disposed within the hydraulic piston pump 12. An electrically controlled valve mechanism 50 is likewise included and associated with the hydraulic piston pump 12 to control fluid flow through the porting arrangement 48. As illustrated in FIG. 1, the apparatus 44 also includes a microprocessor 52 operative to receive the electrical signals "F" representative of the pump's operating parameters, process the electrical signals "F" with respect to programmed parameters and transmit electrical command signals "C" to the electrically controlled valve mechanism 50 to selectively control the flow of fluid in the porting arrangement 48.

The sensor arrangement 46 includes a pressure sensor 54 connected to the conduit 22 and operative to generate an electrical signal "$F_1$" that is representative of the hydraulic piston pump's operating pressure and deliver the signal "$F_1$" through an electrical line 56 to the microprocessor 52. The sensor arrangement 46 also includes a speed sensor 58 associated with the pump input shaft 18 and operative to generate a signal "$F_2$" that is representative of the speed of the pump input shaft 18 and deliver the speed signal "$F_2$" to the microprocessor 52 through an electrical line 60. A displacement sensor 62 is also provided and operatively disposed in the hydraulic piston pump 12 to sense the displacement position of the hydraulic piston pump 12 and deliver an electrical signal "$F_3$" that is representative of the displacement thereof to the microprocessor 52 through an electrical line 64. A piston cylinder position sensor 66 is provided in the hydraulic piston pump 12 and operative to sense the angular position of the piston cylinder barrel and deliver an electrical signal "P" that is representative of the position of the respective piston cylinders to the microprocessor 52 through an electrical line 68.

The porting arrangement 48 includes a secondary port 70 defined in the valve face 30 between the inlet passage 32 and the discharge passage 34, a fluid chamber 72 of a predetermined volumetric size, a first passageway 74 connecting the secondary port 70 and the fluid chamber 72, and a second passageway 76 connecting the fluid chamber 72 and the discharge passage 34. The volumetric size of the fluid chamber 72 is in general on the order of four times the volumetric size of the respective piston cylinders 38 in the cylinder barrel of the hydraulic piston pump 12 when at BDC and maximum displacement.

The electrically controlled valve mechanism 50 includes a first electrically controlled valve 78 disposed in the first passageway 74 and a second electrically controlled valve 80 disposed in the second passageway 76. Each of the first and second electrically controlled valves 78,80 is movable between a spring biased first position at which fluid flow through the respective conduits 74,76 is blocked and a second position at which fluid flow through the respective conduits 74,76 is open. Each of the first and second electrically controlled valves 78,80 is movable towards its second position in response to an electrical signal received from the microprocessor 52. As illustrated, the first and second electrically controlled valves 78,80 are poppet style valves 81 that open in response to the respective electrical signals acting on a solid state motor (SSM) 82. However, it is recognized that other types of electrically controlled valve mechanisms with fast response could be utilized without departing from the essence of the invention.

The electrical command signals "C" delivered by the microprocessor 52 to the electrically controlled valve mechanism 50 includes a first control signal "$C_1$" delivered to the first electrically controlled valve 78 through an electrical line 83. The electrical command signals "C" also includes a second control signal "$C_2$" delivered to the second electrically controlled valve 80 through an electrical line 84.

Figure 5:
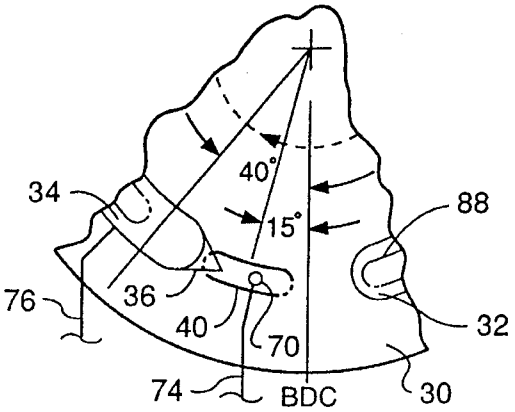
FIG. 5 is a fragmented portion of the valve face of FIG. 3 illustrating the one piston port rotated a further distance from the BDC position.
Figure 4:
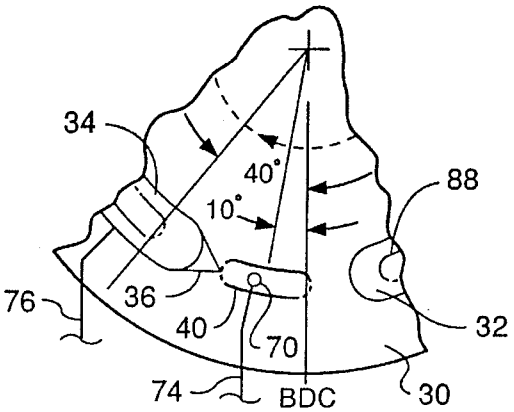
FIG. 4 is a fragmented portion of the valve face of FIG. 3 illustrating the piston port rotated from the BDC position.
Figure 6:
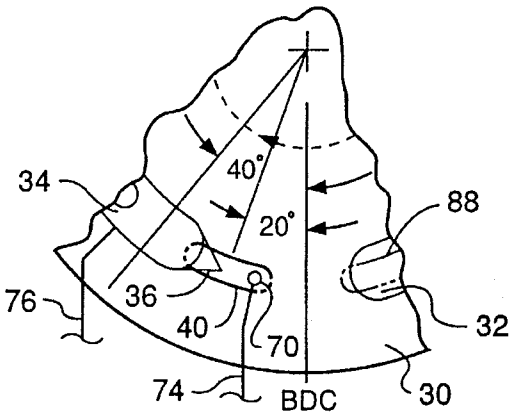
FIG. 6 is a fragmented portion of the valve face of FIG. 3 with the one piston port rotated still further from the BDC position.

As illustrated in FIG. 3, the one piston port 40 is illustrated at the BDC position and as illustrated has just terminated communication with the inlet passage 32 and is ready to communicate with the secondary port 70. In FIG. 4, the one piston port 40 has rotated through an angle of 10° from the BDC position. In this position, the one piston port 40 is in full communication with the secondary port 70 and is nearing communication with the bleed slot 36 of the discharge passage 34. In FIG. 5, the one piston port 40 is in a position 15° from the BDC position. At this position, the one piston port 40 is in full communication with the secondary port 70 and is about to enter into communication with the discharge passage 34. In FIG. 6, the one piston port 40 is in a position 20° from the BDC position. At this position, the one piston port 40 remains in full communication with the secondary port 70 and is in communication with the discharge passage 34. During the subsequent 20° of movement of the one piston port 40, the one piston port 40 remains in communication with the discharge passage 34 but closes off communication with the secondary port 70.

Subsequent to the 40° of rotation of the one piston port 40, another piston port 88 is at the BDC position. This is true based on the fact that the piston pump illustrated has nine pistons and each piston is spaced from the other by an arcuate angle of 40°. It is well recognized that if a hydraulic piston pump having a different number of pistons were to be utilized, the angle between the respective piston ports would vary accordingly. For example, in a hydraulic piston pump having only five pistons, the respective piston ports would be arcuately spaced at 72°. Consequently, the angular movement of each of the piston ports in a five piston hydraulic piston pump would be different than the angular movements set forth above with respect to FIGS. 3–6. The angles represented herein for piston port locations are for illustrative purposes only. Actual port and bleed slot locations may vary depending upon the piston pump and system design requirements.

Figure 7:
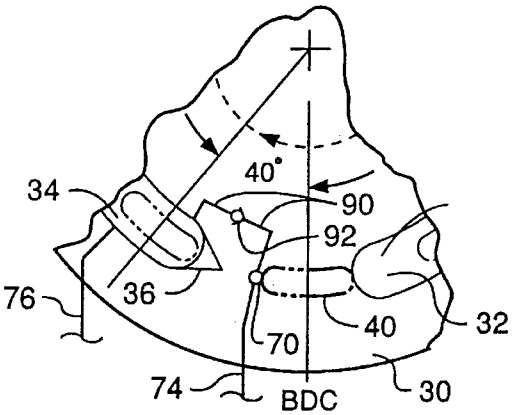
FIG. 7 is a fragmented portion of the valve face of FIG. 3 illustrating another embodiment of the present invention.

Referring to FIG. 7, a modified embodiment of the subject invention is illustrated. In the subject arrangement of FIG. 7, a third passageway 90 is provided between the secondary port 70 and the discharge passage 34. A one-way check valve 92 is disposed in the third passageway 90 and operative to allow communication from the secondary port 70 to the discharge passage 34 and block reverse flow therethrough. With this arrangement, should the pressure in the piston cylinder try to exceed the discharge pressure, the check valve 92 opens, allowing fluid to pass from the piston cylinder through the secondary port 70 to the discharge passage Referring to FIG. 8, a chart illustrates a typical output flow of a hydraulic piston pump not having the subject apparatus 44 for the attenuation of fluid borne noise. The chart illustrates the arcuate travel of one piston port 40 through 40° of arcuate rotation. The desired constant output flow of the piston pump 12 is represented by a dashed line 94 while the actual output flow is illustrated by the solid line 96. As illustrated, through approximately the first 15° of arcuate rotation, there is a marked decrease in the total output flow. For example, at high discharge pressure, such as 6000 psi, the decrease could amount to something on the order of 25% at full displacement to over 100% at low displacement. This marked decrease in output flow is the prime reason for the flow ripple produced by the hydraulic piston pump 12.

Figure 9:
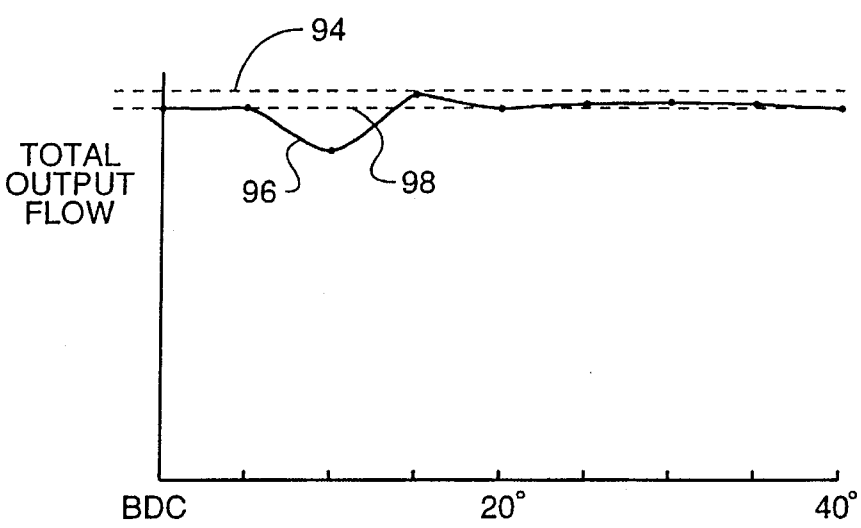
FIG. 9 is a chart diagrammatically illustrating the pump outlet flow over a 40° range according to the subject invention.

Referring to FIG. 9, a chart illustrates the total output flow of the hydraulic piston pump 12 moving through 40° of arcuate movement and including the subject invention. The dashed line 94 again represents the desired constant output flow of the piston pump and the dashed line 98 represents the desired constant output flow of the piston pump incorporating the subject invention. The difference between the dashed line 94 and the dashed line 98 represents the portion of the total fluid flow that is being utilized to bring a piston cylinder cavity leaving BDC up to discharge pressure, but spreading that fluid flow over an entire 40° increment of arcuate rotation. The solid line 96 represents the actual total output flow of the hydraulic piston pump 12 incorporating the subject invention. As illustrated, the degree of droop in the solid line 96 is much less drastic than the droop illustrated in FIG. 8. The reduction in flow would be on the order of 8 to 10% at full displacement versus 25% without the subject invention. Likewise, the droop does not initially occur and it lasts for a shorter duration of arcuate travel.

Figure 11:
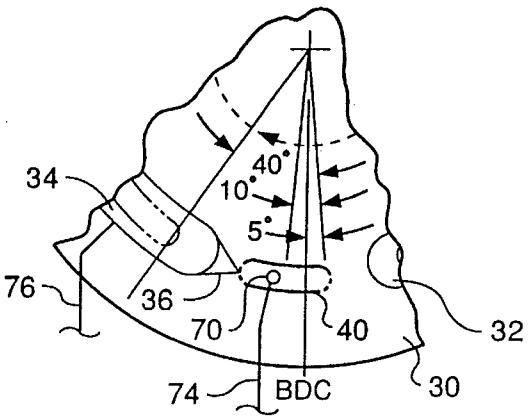
FIG. 11 is a fragmented portion of the valve face illustrated in FIG. 10 with the one piston port rotated a predetermined distance.
Figure 13:
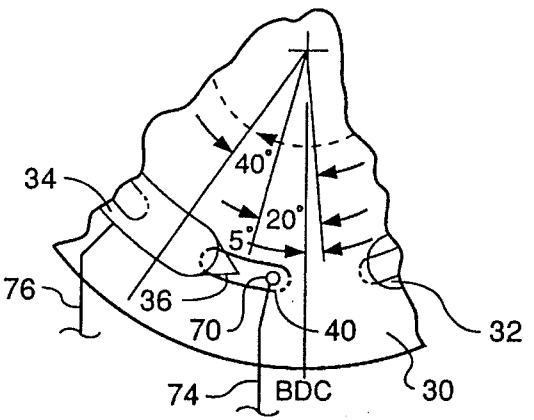
FIG. 13 is a fragmented portion of the valve face of FIG. 10 with the one piston port rotated an additional distance.
Figure 10:
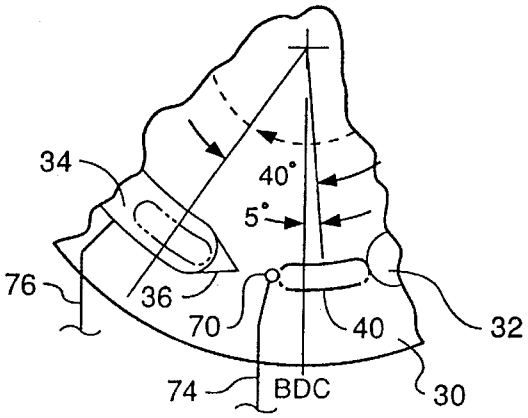
FIG. 10 is a fragmented portion of a modified version of the valve face of FIG. 3 incorporating another embodiment of the present invention.
Figure 12:
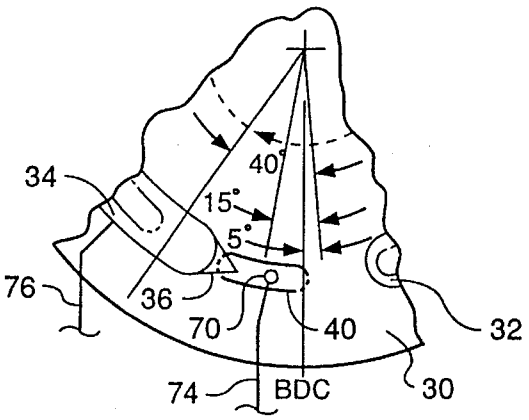
FIG. 12 is a fragmented portion of the valve face of FIG. 10 with the piston port rotated a further distance.

Referring to FIGS. 10–13, another embodiment of the subject invention is illustrated. All like elements have like element numbers. The significant difference between the embodiment illustrated in FIGS. 10–13 as compared to that illustrated in FIGS. 3–6, is that the one piston port 40 is at 5° before the BDC position when it ends communication with the inlet passage 32. Likewise, in this position, the one piston port 40 is ready to communicate with the secondary port 70. In FIG. 11, the one piston port 40 has moved through 10° of arcuate travel from its initial position and is at a point just prior to communicating with the bleed slot 36 of the discharge passage 34. This position generally relates to the position of the one piston port 40 as illustrated in FIG. 4. Likewise, in FIG. 12, the one piston port 40 has rotated through 15° from its initial position and is at a position relative to the valve face 30 like that set forth with respect to FIG. 5. Furthermore, in FIG. 13, the one piston port 40 has moved through 20° of arcuate rotation and relates to the position illustrated in FIG. 6. Again, in the FIGS. 10–13 the only difference is that the inlet passage 30, the secondary port 70, and the discharge passage 34 have been rotated 5° counterclockwise with respect to the BDC position.

It is recognized that various forms of the apparatus 44 and subject hydraulic system 10 could be utilized without departing from the essence of the invention. For example, the first and second electrically controlled valves 78,80 could be integral with the hydraulic piston pump 12 or could be separate therefrom and the first and second passageways 74,76 could be conduits interconnecting the remote fluid chamber 72 with the secondary port 70 and the discharge passage 34. Likewise the fluid chamber 72 could be integral with or remote from the hydraulic piston pump 12. Additionally, the volumetric size of the fluid chamber 72 could be in a range of about three to five times the size of the respective ones of the piston cylinders 38.

INDUSTRIAL APPLICABILITY

Figure 8:
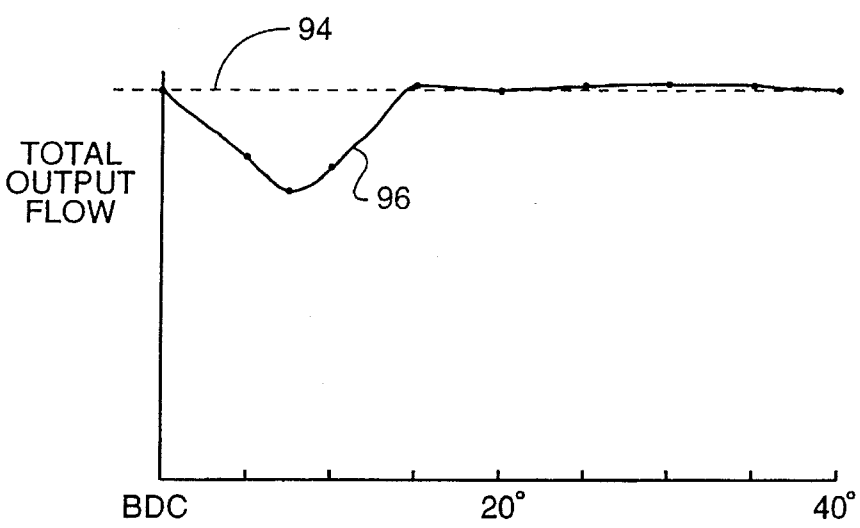
FIG. 8 is a chart generally diagrammatically illustrating the pump outlet flow of a known pump over a 40° increment of rotation based upon a typical porting configuration.

In the operation of a typical hydraulic system, the hydraulic piston pump 12 provides fluid to actuate the hydraulic cylinder 24. The pressure required in the hydraulic system is dependent on the resistance created by the load encountered by the cylinder 24. When there is no load on the cylinder 24, the system pressure is low and thus would result in a flow that is basically cyclic. As the system pressure increases, the cyclic condition changes and the shape of the curve created by the flow output from the pump is generally similar to that set forth with respect to FIG. 8. The droop in the actual total output flow as represented by the solid line 96 is basically attributed to the fact that after the one piston port 40 passes through the BDC position and initiates communication with the bleed slot 36 of the discharge passage 34 it needs to be pressurized to the level of the fluid in the discharge passage 34. As illustrated in FIG. 2, after the one piston port 40 rotates from the BDC position, pressurized fluid from the discharge passage 34 is directed into the one piston port 40 to pressurize the one piston port 40 up to the same level that is present in the discharge passage 34. The droop illustrated in FIG. 8 is one of the main factors contributing to the fluctuation in the flow from the hydraulic piston pump 12 and is that normally referred to as the flow ripple.

In the subject arrangement, and as illustrated in FIGS. 1 & 3, the pressure in the conduit 22 is sensed by the pressure sensor 54, the speed of the pump input shaft 18 is sensed by the speed sensor 58, the displacement of the piston pump 12 is sensed by the displacement sensor 62, and the angular orientation of the piston cylinder barrel is sensed by the piston cylinder position sensor 66. The respective electrical signals "$F_1$,$F_2$,$F_3$,P" are directed to the microprocessor 52. The microprocessor 52 processes the electrical signals in conjunction with programmed information and delivers the first and second control signals $C_1$ and $C_2$ to control the flow through the first and second passageways 74,76.

Referring to FIGS. 3–6, as the one piston port 40 leaves the inlet passage 32 and reaches the BDC position, the microprocessor 52 continues to deliver the second control signal C2 to the second electrically controlled valve 80. This controllably holds the second electrically controlled valve 80 open permitting the pressurized fluid in the discharge passage 34 to pass through the second passageway 76 to pressurize the fluid chamber 72. The second electrically controlled valve 80 is controlled to vary the flow rate between the discharge passage 34 and the fluid chamber 72. Once the one piston port 40 initiates communication with the secondary port 70 the microprocessor 52 directs the first control signal $C_1$ to the first electrically controlled valve 78 to controllably open it allowing fluid flow to communicate between the fluid chamber 72 and the secondary port 70. The first electrically controlled valve 78 is opened at a controlled rate in order to utilize the pressurized fluid in the fluid chamber 72 to pre-pressurize the volume of fluid in the one piston port 40. By using a 4/1 ratio between the volumetric size of the fluid chamber 72 and the volumetric size of the respective piston cylinder, the pressure in the piston port 40 can be increased to approximately 80% of the discharge pressure in the discharge passage 34 prior to the one piston port 40 opening into the bleed slot 36. As the one piston port 40 initiates communication with the bleed slot 36 of the discharge passage 34, the microprocessor 52 modifies the first control signal $C_1$ to close the first electrically controlled valve 78. During the period at which the first electrically controlled valve 78 is open, the second electrically controlled valve 80 is maintained open to the extent that a controlled rate of flow is allowed to pass thereacross. However, once the one piston port 40 begins to enter the bleed slot 36, the second electrically controlled valve 80 is closed. If the operating system is at low pressure and high displacement, the second electrically controlled valve 80 may be opened by varied amounts. As the one piston port 40 continues its movement into the bleed slot 36, the pressure level in the piston cylinder increases to discharge pressure after which the flow therefrom into the discharge passage 34 effectively adds to the total output flow. As the one piston port 40 continues its arcuate rotation, the one piston port 40 is providing its volumetric fluid to the total output flow. However, during this time period, the second electrically controlled valve 80 is controllably maintained open in a flow regulating condition to again pre-pressurize the fluid chamber 72. Once the one piston port 40 has moved through its 40° of arcuate rotation, another piston port 88 is at the BDC position. Each piston port of the plurality of piston ports 38 perform in the same manner as that described above with respect to the one piston port 40.

Referring to the operation of FIG. 7, the arrangement disclosed therein operates in the same manner as that set forth with respect to FIGS. 3–6 when operating at higher system pressures. When the hydraulic piston pump 12 is operating at low pressure and higher displacements, it is likely that the pressure of the fluid volume in the fluid chamber 72 and the pressure in the one cylinder port 40 would reach discharge pressure before the one piston port 40 enters the discharge passage 34. In this instance, the pressurized fluid in the one piston port 40 flows through the third passageway 90 and the one-way check valve 92 into the discharge passage 34. This eliminates the possibility of the pressure in the one piston port 40 reaching some elevated pressure above the system pressure prior to the one piston port 40 communicating with the discharge passage 34 and suddenly releasing a higher flow rate when the one piston port 40 enters the discharge passage 34 and the fluid in the one piston port 40 expands.

Referring to the operations of FIGS. 10–13, the operation thereof is basically the same as that set forth in the embodiment illustrated in FIGS. 3–6. In the arrangement set forth in FIGS. 10–13, the one piston port 40 ends communication with the inlet passage 32 and is ready to initiate communication with the secondary port 70 at a location approximately 5° before BDC. By initiating communication of the one piston port 40 with the secondary port 70 prior to the one piston port 40 reaching the BDC position, the unpressurized fluid in the one piston port 40 is beginning pre-pressurization before the one piston port 40 is in position to be able to initiate any compression of the fluid therein. Consequently, pre-pressurizing of the one piston port 40 starts sooner than that illustrated in FIGS. 3–6 as compared to BDC position. The subject arrangement in FIGS. 10–13 is beneficial in that the velocity of a piston within the piston pump is lower when it starts adding flow to the discharge flow, thus resulting in a smaller increase in total flow when the piston actually starts producing fluid flow. This further aids in reducing the amplitude of the flow ripple.

From a review of the above, it should be apparent that the variation in piston pump 12 flow to the hydraulic system 10 is readily reduced by using the subject apparatus 44 having a porting arrangement 48 and the volume of fluid in the fluid chamber 72 within the hydraulic piston pump 12 to aid in pressurizing the respective ones of the plurality of piston ports 38 prior to the respective piston ports entering the discharge passage 34. In this manner, the fluid flow required to bring the respective piston ports 38 up to the discharge pressure is spread over the entire 40° of arcuate rotation between the cylinder ports rather than only 10° or 15° of cylinder barrel rotation. The subject arrangement substantially reduces the variation in output flow.

Other aspects, objects, and advantages of the invention can be obtained from a study of the drawings, the disclosure, and the appended claims.

I claim:

1. Apparatus for the attenuation of fluid borne noise in a hydraulic system caused by flow ripples produced by a hydraulic piston pump that is drivingly connected by a pump input shaft to a power source, the hydraulic piston pump having an inlet passage, a discharge passage, a bottom dead center position (BDC) between the inlet passage and the discharge passage, and a plurality of piston ports that are rotatably disposed relative to the inlet passage, the bottom dead center position, and the discharge passage, the apparatus comprising:

a sensor arrangement operative to sense the piston pump's operating parameters and generate electrical signals representative of the pump's operating parameters;

a porting arrangement within the hydraulic piston pump including a secondary port disposed between the inlet passage and the discharge passage, a fluid chamber of a predetermined volumetric size, a first passageway connecting the secondary port with the fluid chamber, a second passageway connecting the fluid chamber with the discharge passage and an electrically controlled valve mechanism disposed in the first and second passageways and operative to control fluid flow between the secondary port, the fluid chamber and the discharge passage; and a microprocessor operative to receive the electrical signals representative of the pump's operating parameters, process the signals with respect to programmed parameters and transmit electrical command signals to the electrically controlled valve mechanism to selectively control the flow of fluid between the secondary port, the fluid chamber and the discharge passage in response to the pump's operating parameters.

2. The apparatus of claim 1, wherein, in use, each of the piston ports rotates through the bottom dead center position and each of the piston ports communicate with the secondary port generally adjacent the bottom dead center position.

3. The apparatus of claim 2, wherein, in use, after each piston port communicates with the secondary port it rotates through a predetermined distance past the bottom dead center position prior to communicating with the discharge passage.

4. The apparatus of claim 3, wherein, in use, each of the piston ports communicate with the secondary port in proximity to ending communication with the inlet passage.

5. The apparatus of claim 4, wherein the electrically controlled valve mechanism includes a first electrically controlled valve disposed in the first passageway between the secondary port and the fluid chamber and a second electrically controlled valve disposed in the second passageway between the fluid chamber and the discharge passage.

6. The apparatus of claim 5, wherein the electrical command signals from the microprocessor to the electrically controlled valve mechanism includes a first control signal to the first electrically controlled valve and a second control signal to the second electrically controlled valve.

7. The apparatus of claim 6, wherein a bleed slot is disposed at one end of the discharge passage on the end thereof adjacent the secondary port and, in use, the second electrically controlled valve is maintained in a controlled open position to connect the bleed slot and the discharge passage with the fluid chamber as each of the piston ports rotate through the bottom dead center position and the first electrically controlled valve is controllably opened as each of the piston ports communicate with the secondary port and closes as each of the piston ports communicates with the bleed slot.

8. The apparatus of claim 7, wherein the porting arrangement includes a third passageway connecting the secondary port and the discharge passage and the third passageway has a one way check valve disposed therein to only permit communication from the secondary port to the discharge passage.

9. The apparatus of claim 7, wherein the first electrically controlled valve is open only during approximately ten degrees of rotation of each of the piston ports.

10. The apparatus of claim 7, wherein, in use, each of the piston ports communicate with the secondary port prior to the piston port reaching the bottom dead center position.

11. The apparatus of claim 7, wherein the sensor arrangement includes a pressure sensor connected to the hydraulic system and operative to transmit an electrical signal representative of the pressure in the hydraulic system to the microprocessor and a speed sensor associated with the pump input shaft and operative to transmit an electrical signal to the microprocessor that is representative of the speed of the pump input shaft.

12. The apparatus of claim 11, wherein the sensor arrangement includes a displacement sensor disposed in the hydraulic piston pump and operative to transmit an electrical signal to the microprocessor that is representative of the displacement of the hydraulic piston pump and a piston cylinder barrel position sensor disposed in the hydraulic piston pump and operative to transmit an electrical signal to the microprocessor that is representative of the angular position of the piston cylinder barrel therein.

* * * * *